United States Patent [19]

Ludwig

[11] 4,090,875

[45] May 23, 1978

[54] DUCTILE TUNGSTEN-NICKEL-ALLOY AND METHOD FOR MANUFACTURING SAME

[75] Inventor: Robert L. Ludwig, Kingston, Tenn.

[73] Assignee: The United States of America as represented by the Department of Energy, Washington, D.C.

[21] Appl. No.: 402,413

[22] Filed: Oct. 1, 1973

[51] Int. Cl.[2] ..... C22C 1/04; C22C 27/04

[52] U.S. Cl. ..... 75/248; 75/176; 75/223; 75/226; 148/126

[58] Field of Search ..... 75/176, 223, 225, 226, 75/248; 148/32, 126, 133; 29/182

[56] References Cited

U.S. PATENT DOCUMENTS

| | | | |
|---|---|---|---|
| 2,793,951 | 5/1957 | Green et al. | 75/176 X |
| 3,177,076 | 4/1965 | Timmons et al. | 75/176 |
| 3,307,982 | 3/1967 | Milligan et al. | 75/176 X |

OTHER PUBLICATIONS

Properties of Tungsten and Tungsten Alloys for Reactor Shielding Applications, Watts, AEC Report Y-1675, Jun. 1969, pp. 8, 9, 15 & 17.

*Primary Examiner*—Arthur J. Steiner
*Attorney, Agent, or Firm*—Dean F. Carlson; Stephen D. Hamel; Earl L. Larcher

[57] ABSTRACT

The tensile elongation of a tungsten-nickel-iron alloy containing essentially 95 weight percent reprocessed tungsten, 3.5 weight percent nickel, and 1.5 weight percent iron is increased from a value of less than about 1 percent up to about 23 percent by the addition of less than 0.5 weight percent of a reactive metal consisting of niobium and zirconium.

2 Claims, No Drawings

DUCTILE TUNGSTEN-NICKEL-ALLOY AND METHOD FOR MANUFACTURING SAME

The present invention relates to tungsten-nickel-iron alloys, and more particularly to the improvement of the tensile elongation of such an alloy wherein the tungsten is reprocessed or contains a sufficient concentration of impurities so as to normally impart a tensile elongation of less than one percent to the alloy.

Tungsten possesses several properties which render it particularly suitable for use in application where high tensile strength, high density, high thermal resistance, and certain electrical properties are desired. Usually tungsten, which is characterized by its brittleness and poor machinability, is utilized in tungsten-base alloys so as to obtain the benefit of the tungsten properties while introducing a more suitable level of machinability, ductility and structural strength. Tunsten-base alloys are manufactured by employing powder metallurgical techniques wherein the alloying elements in powdered form are pressed into an article of the desired configuration and then sintered to bond the particular mass together.

Of the various known tungsten-base alloys, a tunsten-nickel-iron alloy, particularly one having a composition of 3.5 weight percent nickel, 1.5 weight percent iron and the remainder tungsten, has proven to be highly useful due to relative ease of machinability and high tensile elongation and structural strength. These tungsten-nickel-iron alloys are prepared by employing standard metallurgical procedures in which highly pure metal powders in the required proportions and an average particle size of 1 to about 44 microns are blended and isostatically pressed at a pressure in the range of about 10 to 15 tons per square inch. This pressed composite is then sintered in a hydrogen atmosphere at a temperature at which the nickel and iron components of the alloy dissolve a portion of the tungsten and form a liquid matrix phase for joining together the tungsten particulates. A liquid phase necessary for providing the nickel-iron-tungsten matrix may be achieved by heating the powders at a temperature in the range of about 1440° to 1470° C. for a duration in the range of about 0.5 to 2 hours depending upon the particular configuration and cross-sectional dimensions of the tungsten alloy article. After sintering the resulting compact is preferably annealed in a vacuum of about 1 to $10^{-6}$ mm mercury for about 2 to 50 hours in the temperature range of 700° to 1300° C. for the purpose of attaining maximum ductility.

The use of virgin tungsten for the manufacture of the tungsten-based alloys has proven to be relatively expensive but efforts to decrease the cost of the tungsten alloys of the type described herein by employing salvaged or reprocessed tungsten have not been adequately successful. It has been found that when a tungsten-nickel-iron alloy of the aforementioned composition using salvaged tungsten metal which had been processed for purification and particle sizing was prepared by the usual metallurgical procedures the alloy was extremely brittle and possessed a tensile elongation of less than 1 percent. This shortcoming in the manufacture of this particular tungsten-base alloy using salvaged tungsten is apparently due to an oxygen concentration of greater than approximately 500 ppm in the tungsten powder. Also, the presence of as much as 50 parts per million by weight of phosphorus and 3 parts per million by weight of sulphur in the salvaged tungsten powder is believed to contribute to the brittleness of the finished alloy. Virgin tungsten normally contains less than one-fifth of these quantities. It is believed that the reason for the brittleness is due to the concentration of these impurities, particularly oxygen, at the interface between the tungsten particles and the nickel-iron-tungsten matrix so as to detract from the bond between the tungsten powder and the matrix material.

Accordingly, it is the principal aim or objective of the present invention to obviate the above and other shortcomings by providing a tungsten-nickel-iron alloy of essentially the aforementioned composition which is prepared from reprocessed tungsten powder and possesses a tensile elongation up to about 23 times that previously obtained. This goal is achieved by adding about 0.05 to 0.5 weight percent (500 to 5,000 ppm) of a reactive metal selected from niobium or zirconium to the alloy mixture prior to the pressing and sintering steps.

Other and further objects of the invention will be obvious upon an understanding of the illustrative product and method about to be described, or will be indicated in the appended claims, and various advantages not referred to herein will occur to one skilled in the art upon employment of the invention in practice.

Described generally, the tungsten-nickel-iron alloy of the present invention is prepared from tungsten powder which has been salvaged or reprocessed in any suitable manner such as those normally employed by manufacturers of lamp grade and high green strength tungsten powders. These powders, while of substantial purity, have been found to possess oxygen contents greater than about 500 ppm as well as some impurities such as phosphorus and sulphur. The salvaged or reprocessed tungsten powder is combined with nickel in the concentration of 3.5 weight percent, iron concentration of 1.5 weight percent, and niobium or zirconium in the concentration of 0.05 to 0.5 weight percent. The reprocessed tungsten powder in a particle size range of about 1 to 10 microns, and the other elements less than 44 microns in size are blended together in any suitable mechanism and then pressed and sintered as described above. The alloy produced from this composition possesses a tensile elongation in the range of about 9 to 26 percent in one inch, which represents a significant increase in ductility over these tungsten alloys of essentially similar compositions heretofore prepared. While it is not exactly known why the addition of the reactive metal — niobium or zirconium — to the tungsten metal alloy functions to produce the increased ductility, it is believed that the reactive metal acts as a getter for the oxygen and/or other impurities in the tungsten. It is also speculated that the reactive metal may function to change the wetting characteristics of the nickel-iron matrix by collecting one or more of the impurities normally present in a very thin layer at the interphase interface. The particular concentration of the reactive metal to the tungsten-nickel-iron alloy is in a range from an effective amount which will increase the percentage of tensile elongation a given quantity to an amount at which no further increase in tensile elongation or other properties is obtainable. This range is believed to be of about 0.05 to 0.5 weight percent of the alloy. The reactive metal replaces the tungsten in the composition. This concentration of reactive metal has been satisfactory to increase the tensile elongation of reprocessed tungsten having oxygen impurity levels as high as 2,000 ppm. Of course, if oxygen levels greater than about 2,000 ppm in tungsten salvage are encountered it may require the use of a greater quantity of reactive metal to provide the desired increase in tensile elongation. The niobium is added to the alloy mixture in the form of metal powder while the zirconium is preferably added as zirconium hydride since zirconium metal powder has been judged hazardous to handle.

In order to provide a clearer understanding of the present invention examples directed to the formation of bars of tungsten-nickel-iron alloy of the aforementioned composition are set forth below with the additive being niobium and zirconcium in hydride form.

EXAMPLE I

In a demonstration of the subject development, a blend of alloy powder containing 3.5 weight percent nickel powder, 1.5 weight percent iron powder, and the remainder reprocessed tungsten powder was divided into two portions. Twelve hundred ppm of high-purity noibium powder were added to one portion of the original blend. Three bars, 0.75 inch in diameter and 6 inches in length, were pressed from one portion free of the niobium and four similar bars were pressed from the portion containing the niobium addition. Each of the bars was isostatically pressed with a pressure of 30,000 psi at a temperature of 25° C. in vacuum for 1 minute. The seven bars were simultaneously sintered in wet hydrogen at a temperature of 1470° C. at a pressure of one atmosphere and annealed as a group at 1200° C. for 6 hours in vacuum. Two tensile specimens were machined from each bar and the gage lengths of all bars were polished lengthwise to remove machining mark stress risers. The tensile properties of the above described specimens are listed in Table I. The tensile property data indicate an increase in the elongation from less than one percent without niobium to an average of 23 percent with the niobium addition.

TABLE I

Tensile Properties of Reprocessed Tungsten-3.5 Nickel-1.5 Iron Alloy With and Without 1,200 PPM Niobium Added

| Sample No. | Niobium Addition (ppm) | Ultimate Tensile Strength (psi) | Tensile Yield Strength[a] (psi) | Percent Elongation (in one inch) | Percent Reduction in Area |
|---|---|---|---|---|---|
| 1 | — | 74,700 | b | <1 | 1.2 |
| 2 | — | 73,800 | b | <1 | <1 |
| 3 | — | 65,200 | b | <1 | 0 |
| 4 | — | 68,500 | b | <1 | 0 |
| 5 | — | 77,100 | b | <1 | 0 |
| 6 | — | 70,400 | b | <1 | 0 |
| 7 | 1,200 | 136,500 | 90,000 | 24.0 | 22.6 |
| 8 | 1,200 | 136,600 | 90,800 | 22.5 | 20.4 |
| 9 | 1,200 | 137,300 | 88,500 | 22.0 | 20.2 |
| 10 | 1,200 | 136,400 | 86,100 | 25.5 | 24.6 |
| 11 | 1,200 | 136,700 | 90,500 | 22.0 | 20.2 |
| 12 | 1,200 | 137,000 | 87,800 | 23.5 | 20.1 |
| 13 | 1,200 | 137,200 | 89,300 | 20.0 | 17.2 |
| 14 | 1,200 | 136,400 | 90,500 | 20.5 | 19.0 |

[a]0.2 percent offset
[b]Broke before yield

EXAMPLE II

Similarly, 1200 ppm of high purity zirconium hydride was added to a blend of 3.5 weight percent nickel powder, 1.5 weight percent iron powder, and reprocessed tungsten powder. One bar 0.75 inch in diameter and six inches in length was isostatically pressed with a pressure of 30,000 psi at a temperature of 25° C. in vacuum for one minute. The bar was sintered in wet hydrogen at a pressure of one atmosphere at a temperature of 1470° C. and then heat treated for 36 hours in vacuum at 1100° C. Two tensile specimens were machined from the bar and the gage length of the bars was polished lengthwise to remove machining mark stress risers. Table II shows that the tensile elongation increased from less than one percent as in Table I to 9 to 15 percent.

TABLE II

Tensile Properties of Reprocessed Tungsten-3.5 Nickel-1.5 Iron Alloy With 1,200 PPM Zirconium Hydride Added

| Sample Number | Ultimate Tensile Strength (psi) | Tensile Yield Strength[a] (psi) | Percent Elongation (in one inch) | Percent Reduction in Area |
|---|---|---|---|---|
| 1 | 130,800 | 85,300 | 15.0 | 13.1 |
| 2 | 126,900 | 89,200 | 9.0 | 8.6 |

[a]0.2 percent offset

It will be seen that the present invention affords a simple economic method for preparing tungsten-nickel-iron alloys from tungsten powder which would normally not be usable for forming such alloys due to the excessive brittleness of the finished product.

What is claimed is:

1. A tungsten-base alloy consisting of about 95 weight percent reprocessed tungsten having an oxygen content in the range of about 500 to 2000 ppm, 3.5 weight percent nickel, 1.5 weight percent iron, and a metal selected from the group consisting of niobium and zirconium in a concentration of about 0.05 to 0.5 weight percent for increasing the tensile elongation of the alloy by a factor of at least about 9 over that obtainable without the addition of said metal.

2. The method of manufacturing a tungsten-nickel-iron alloy which includes the steps of preparing a mixture consisting of about 95 weight percent tungsten powder characterized by being reprocessed and containing an oxygen concentration in the range of about 500 to 2000 ppm, 3.5 weight percent nickel powder, 1.5 weight percent iron powder, mixing said powder mixture with a metal powder selected from the group consisting of niobium and zirconium with said metal powder being in an amount in the range of 0.05 to 0.5 weight percent for increasing the tensile elongation of the alloy over that obtainable without the addition of said metal powder, isostatically pressing the resulting mixture at a pressure in the range of 10 to 15 tons per square inch, heating the pressed mixture in a hydrogen atmosphere to a temperature in the range of 1440° to 1470° C. for a duration adequate to sinter the mixture, and thereafter annealing the resulting sintered compact in vacuum at a temperature in the range of 700° to 1300° C. for 2 to 50 hours.

* * * * *